US010199711B2

(12) United States Patent
Walker et al.

(10) Patent No.: US 10,199,711 B2
(45) Date of Patent: Feb. 5, 2019

(54) DEPLOYABLE REFLECTOR ANTENNA

(71) Applicants: The Arizona Board of Regents on Behalf of the University of Arizona, Tucson, AZ (US); Southwest Research Institute, San Antonio, TX (US)

(72) Inventors: Christopher K. Walker, Tucson, AZ (US); Ira Steve Smith, Jr., Utopia, TX (US)

(73) Assignees: The Arizona Board Of Regents On Behalf Of The University of Arizona, Tucson, AZ (US); Southwest Research Institute, San Antonio, TX (US)

( * ) Notice: Subject to any disclaimer, the term of this patent is extended or adjusted under 35 U.S.C. 154(b) by 234 days.

(21) Appl. No.: 15/154,760

(22) Filed: May 13, 2016

(65) Prior Publication Data

US 2017/0256840 A1 Sep. 7, 2017

Related U.S. Application Data

(60) Provisional application No. 62/161,033, filed on May 13, 2015.

(51) Int. Cl.

| | |
|---|---|
| ***H01Q 1/08*** | (2006.01) |
| ***H01Q 15/16*** | (2006.01) |
| ***H01Q 1/28*** | (2006.01) |

(52) U.S. Cl.

CPC ..... *H01Q 1/082* (2013.01); *H01Q 1/288* (2013.01); *H01Q 15/161* (2013.01); *H01Q 15/163* (2013.01)

(58) Field of Classification Search

CPC ..... H01Q 15/163; H01Q 1/081; H01Q 1/082; H01Q 1/288; H01Q 15/161

See application file for complete search history.

(56) References Cited

U.S. PATENT DOCUMENTS

| | | | | |
|---|---|---|---|---|
| 2,913,726 | A | 11/1959 | Currie | |
| 6,252,562 | B1 | 6/2001 | Diez | |
| 6,650,304 | B2 | 11/2003 | Lee et al. | |
| 7,224,322 | B1 | 5/2007 | Ghaleb et al. | |
| 7,438,261 | B2 | 10/2008 | Porter | |
| 8,970,447 | B2 | 3/2015 | Ochoa et al. | |
| 9,475,567 | B1 * | 10/2016 | Roach | B64B 1/58 |
| 9,748,628 | B1 * | 8/2017 | Hiller | H01Q 1/081 |
| 2005/0179615 | A1 * | 8/2005 | Mrstik | H01Q 1/082 343/915 |
| 2013/0342412 | A1 | 12/2013 | Jackson et al. | |
| 2014/0225798 | A1 | 8/2014 | Huber et al. | |
| 2014/0266969 | A1 * | 9/2014 | Clayton | H01Q 1/082 343/878 |
| 2016/0197394 | A1 * | 7/2016 | Harvey | H01Q 1/28 343/837 |

OTHER PUBLICATIONS

International Search Report and Written Opinion issued in PCT/US2017/032446 dated Jul. 21, 2017.

* cited by examiner

*Primary Examiner* — Robert Karacsony

(74) *Attorney, Agent, or Firm* — Blank Rome LLP

(57) ABSTRACT

A balloon reflector antenna for a satellite, including a spherical balloon with a surface transparent to electromagnetic waves and a reflective surface opposite the transparent surface. The balloon reflector antenna may further include a feed system extending from the center of the balloon that receives electromagnetic waves reflected off the reflective surface and/or outputs electromagnetic waves that are reflected off the reflective surface.

23 Claims, 3 Drawing Sheets

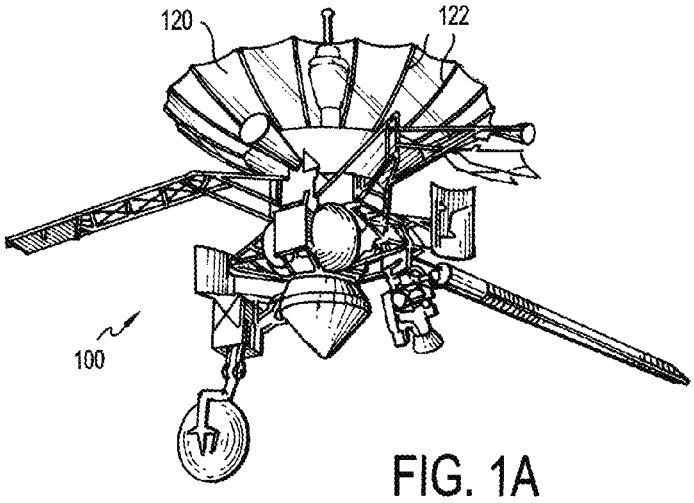
FIG. 1A
FIG. 1B
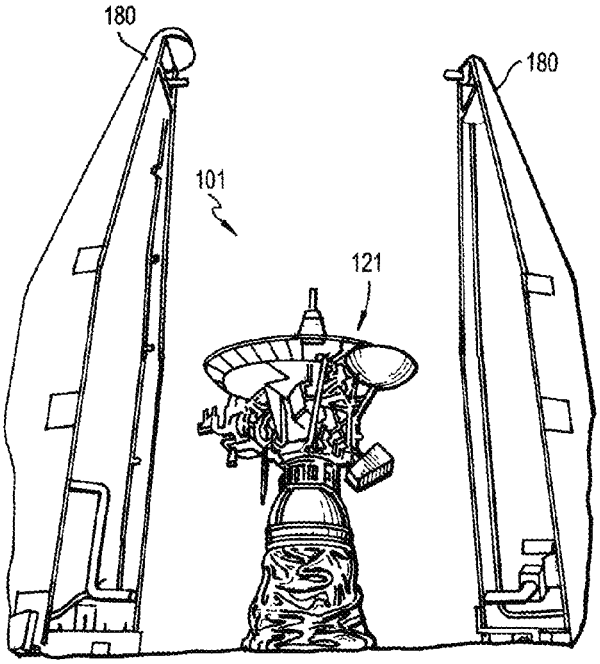

DEPLOYABLE REFLECTOR ANTENNA

CROSS-REFERENCE TO RELATED APPLICATIONS

This application claims priority to U.S. Prov. Pat. Appl. No. 62/161,033, filed May 13, 2015, which is incorporated herein by reference in its entirety.

STATEMENT REGARDING FEDERALLY SPONSORED RESEARCH

Not applicable.

BACKGROUND

High gain space antennas have a number of military and civilian uses, including (secure or unsecure) point-to-point communications, satellite imaging, and synthetic aperture radar (SAR), as well as for planetary and astrophysics research. In point-to-point communications applications, increasing antenna gain increases the data rates at frequencies of interest, allowing ground users to receive more data (e.g., higher resolution images) using devices with smaller antennas (e.g., handheld devices).

In satellite imaging applications, increasing antenna gain allows higher resolution images to be transmitted to the ground in real time. With conventional satellite antennas, satellite images must be transmitted at lower resolutions because of limited available bandwidth.

Synthetic aperture radar uses the motion of the radar antenna to create images of objects on the ground with a finer spatial resolution than is possible with conventional beam-scanning radars. In SAR applications, increasing antenna gain enables the SAR to capture images with higher resolution and better contrast (i.e., greater sensitivity).

Antenna gain may be increased by increasing the diameter of the antenna. Conventional large diameter antennas, however, often have complex deployment mechanisms and, due to their mass and volume, are expensive to transport into space and place in orbit. Some high gain antennas may even require a dedicated launch vehicle.

FIGS. 1A and 1B are diagrams that illustrate conventional spacecrafts 100 and 101, including conventional parabolic antennas 120 and 121.

FIG. 1A illustrates a conventional spacecraft 100 with a conventional ribbed (i.e., umbrella) antenna structure 120. The parabolic antenna structure 120 includes ribs 122 to maintain the parabolic shape. In the past the complexity of the rib structure has led to notable deployment failures (e.g., the Galileo Jupiter probe shown in FIG. 1A). Because the parabola does not collapse in three dimensions, the launch volume of the conventional antenna structure 120 is proportional to the cube of the linear dimension.

FIG. 1B illustrates a conventional spacecraft 101 with a solid parabolic dish 121 stowed for transport in a rocket fairing 180. Because the parabola does not collapse in three dimensions, the launch volume of the parabolic dish 121 is proportional to the cube of the linear dimension.

Because of their size and weight, conventional satellites are expensive to deploy. A satellite with a conventional 5 m antenna, for example, may have a mass of approximately 50 to 80 kilograms and a stowed volume of approximately $1\times10^6$ cubic centimeters. Conventional satellites 100 and 101 also require significant power and include large, heavy components such as a transmitter, power management, and thermal control.

Additionally, in order to reposition a conventional satellite antenna and direct the beam to a new location, the entire satellite must be rotated. The components necessary to rotate a satellite add to the cost to manufacture the satellite and, because they add additional size and weight, further increase the cost to deploy the satellite.

Because of the expense to deploy conventional high gain spacecraft antennas, there is a need for a high gain antenna with a reduced stowed volume and the weight. Additionally, there is a need for a high gain spacecraft antenna that can be repositioned without repositioning the entire spacecraft.

SUMMARY

In order to overcome those and other drawbacks with conventional spacecraft antennas, there is provided a balloon reflector antenna for a spacecraft, including a spherical balloon with one surface transparent to electromagnetic waves and a reflective surface opposite the transparent surface. The balloon reflector antenna may include a feed system extending from the center of the balloon that receives or transmits electromagnetic waves from or to the reflective surface.

BRIEF DESCRIPTION OF THE DRAWINGS

Aspects of exemplary embodiments may be better understood with reference to the accompanying drawings. The components in the drawings are not necessarily to scale, emphasis instead being placed upon illustrating the principles of exemplary embodiments, wherein:

FIGS. 1A and 1B are diagrams illustrating conventional spacecraft with conventional parabolic antennas.

DETAILED DESCRIPTION

Figure 2:
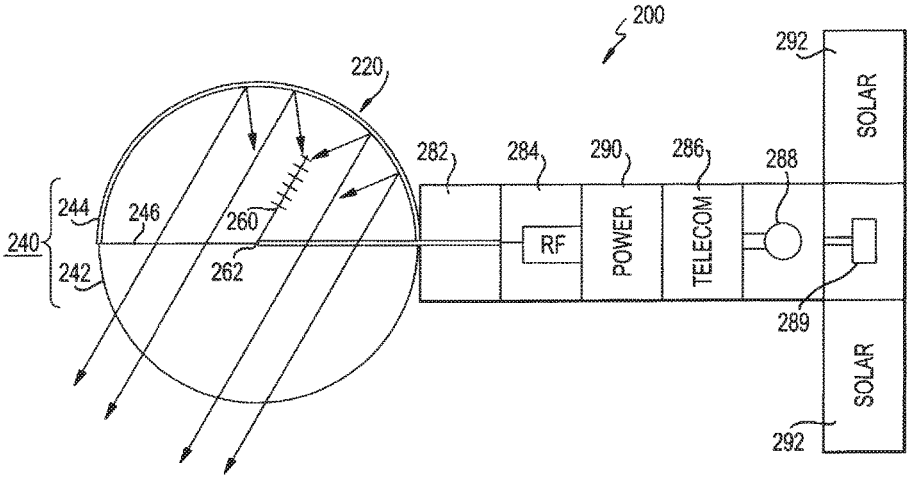
FIG. 2 is a diagram illustrating a satellite with a large balloon reflector antenna as deployed in space according to an exemplary embodiment of the present invention.

Preferred embodiments of the present invention will be set forth in detail with reference to the drawings, in which like reference numerals refer to like elements or steps throughout.

FIG. 2 is a diagram illustrating a satellite 200 with a large balloon reflector antenna 220 as deployed in space according to an exemplary embodiment of the present invention. The balloon reflector antenna 220 provides high gain and enables the satellite 200 to maintain a small launch volume and low mass.

As shown in FIG. 2, the balloon reflector antenna 220 includes a spherical balloon 240. The balloon 240 includes a surface transparent to electromagnetic waves 242 and a reflective surface 244 opposite the transparent surface 242. The balloon 240 may also include one or more dielectic support curtains 246 to help the balloon 240 keep its spherical shape. The satellite 200 also includes a balloon reflector canister 282, an RF module 284, a telecommunications module 286, a pitch reaction wheel 288, a roll reaction wheel 289, a power module 290, and solar cells 292.

The balloon reflector antenna 220 may include a feed system 260. The feed system 260 may be any suitable device that receives electromagnetic waves that are reflected off the reflective surface 244 or emits electromagnetic waves that are reflected off the reflective surface 244. For example, the feed system 260 may include one or more feedhorns, one or more planar antennas, one or more spherical correctors such as a quasi-optical spherical corrector or a line feed (as illustrated in FIG. 2), etc. The feed system 260 may extend from the center of the balloon 240 along one or more radial lines of the balloon 240. The feed system 260 may include a motorized mount 262 at the center of the balloon 240 to pivot the feed system 260.

In order to focus the balloon reflector antenna 220, the feed system 260 may include the motorized mount 262 to move the feed system 260 radially. Because the line of focus of the balloon reflector antenna 220 can be any radius of the spherical balloon 240, the antenna beam is easily steered through large angles without degradation. If the reflective surface 244 encompasses nearly an entire hemisphere of the balloon reflector antenna 220, the antenna beam may be steered at angles±30 degrees.

When the balloon reflector antenna 220 receives a signal (e.g., from the ground), the signal passes through the transparent surface 242 and encounters the reflective surface 244, which focuses the signal into the feed system 260. When the balloon reflector antenna 220 transmits a signal (e.g., to the ground), the signal is emitted by the feed system 260 and encounters the reflective surface 244, which directs the signal through the transparent surface 242. In one embodiment, a balloon reflector antenna 220 with a 1 meter diameter reflective surface 244 yields a 2 degree beam at X-band frequencies (i.e., 8.0 to 12.0 gigahertz). At an altitude of 450 kilometers, the beamwidth on the ground from the 1 meter balloon reflector antenna 220 is approximately 10 miles. At X-band frequencies, the support uplink and downlink data rates of the balloon reflector antenna 220 are between 3 and 50 megabits per second (or more, depending on balloon reflector diameter and transmitter power) for Ethernet-like connections. In addition to X-band communications, the balloon reflector antenna 220 may provide high bandwidth communications at other frequencies (e.g., W-band, V-band, Ka-band, Ku-band, K-band, C-band, S-band, or L-band frequencies).

The motorized mount 262 enables the beam to be steered without rotating the entire satellite 200. In one embodiment, the beam can be precisely steered over a ±150 mile radius by pivoting the feed system 260.

The transparent surface 242 may be any flexible material with a low absorption rate (e.g., less than 1 percent) at the wavelength of interest. For example, the transparent surface 242 may be a flexible polymer such as an approximately 0.5 mil thick Mylar skin (e.g., a 0.5 mil±1 mil Mylar skin). The roughness of the transparent surface 242 may be less than or equal to ⅓the wavelength of interest.

The reflective surface 244 may be any suitable material that reflects electromagnetic waves at the wavelength of interest. For example, the reflective surface 244 may be an approximately 0.5 micron (e.g., 0.5 micron±0.1 micron) metallic coating applied the material that forms the transparent surface 242. Because the transparent surface 242 is thin and transparent, the metallic coating may be applied to the inside surface or the outside surface of the balloon 240 to form the reflective surface 244. The metallic coating is applied to an area on one hemisphere of the balloon reflector antenna 220. The reflective surface 244 may be almost an entire hemisphere of the balloon reflector antenna 220 opposite the transparent surface 242.

NASA deployed metalized balloon satellites from 1960 through 1966. Known as Project Echo, Passive Communications Satellite (PasComSat or OV1-8), and Passive Geodetic Earth Orbiting Satellite (PAGEOS), the satellites functioned merely as reflectors that, when placed in low Earth orbit, would reflect signals from one point on the Earth's surface to another. Unlike the previous metalized balloon satellites, the balloon reflector antenna 220 uses the interior surface of the sphere to form a hemispherical antenna.

The balloon reflector antenna 220 may be combined with convention satellite components to form the satellite 200. For example, the RF module 284 may send or receive signals via the feed system 260. The RF module 284 may be electrically connected to the feed system 260 through a flexible, low-loss coaxial cable, a microstrip/slot line, etc. The telecommunications module 286 may include conventional satellite communications equipment to enable the satellite 200 to receive command and control signals via the balloon reflector antenna 220. The pitch wheel 288 and the roll wheel 289 control the attitude of the satellite 200. The power module 290 stores power in a battery received from the solar panels 292, which may provide approximately 80 watts of peak power.

In one embodiment, the RF module 284, the telecommunications module 286, the pitch wheel 288, the roll wheel 289, and the power module 290 may be CubeSat units. A CubeSat is a miniaturized satellite made up of multiples of 10×10×11.35 cm cubic units. CubeSats have a mass of no more than 1.33 kilograms per unit, and often use commercial off-the-shelf components for their electronics and structure. The balloon reflector antenna 220 also provides aerodynamic stability to the satellite 200. For example, the modules (e.g., CubeSat modules) may be oriented in the direction of travel such that articles in the atmosphere wrap around the balloon and stabilize the satellite 200.

Figure 3:
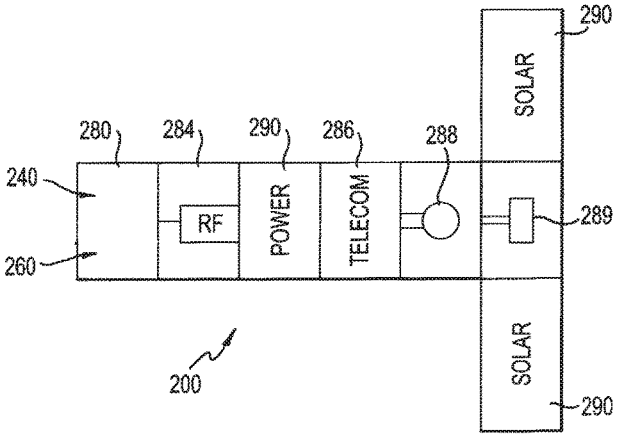
FIG. 3 is a diagram illustrating the balloon reflector antenna of FIG. 2 stowed for launch according to an exemplary embodiment of the present invention

FIG. 3 is a diagram illustrating the satellite 200 with the balloon reflector antenna 220 stowed for launch according to an exemplary embodiment of the present invention. As shown in FIG. 3, the balloon reflector antenna 220 is stowed uninflated in the balloon reflector canister 282 during launch.

For small satellites, it is often harder to meet the volume constraint than it is to meet the mass constraint. Unlike conventional parabolic antennas, the diameter of the balloon reflector antenna 220 is unrelated to the volume of the balloon reflector antenna 220 when stowed for launch. As a result, a collapsed balloon reflector antenna 220 can fit into otherwise unused space within the structure of a small satellite 200. In one embodiment, for example, a small (e.g., 1-2 meter) balloon reflector antenna 220 can stow in one or more 1 U CubeSat units. In another embodiment, a large (e.g., 10 meter) balloon reflector antenna 220 and associated RF payload can easily fit into existing rocket fairings.

Referring back to FIG. 2, when deployed in space, the balloon reflector antenna 220 is inflated to form the spherical shape. For example, a small gas cylinder or a cylinder containing sublimating chemicals may be opened to inflate the balloon reflector antenna 220 out the back of the balloon reflector canister 282. As described above, the balloon reflector antenna 220 may include one or more dielectric support curtains 246 (for example, along the equatorial plane of the balloon reflector antenna 220) that expand with the balloon reflector antenna 220. The dielectric support curtain(s) 246 may help ensure that the balloon reflector antenna 220 maintains its spherical shape. For example, to support aperture efficiency, the balloon reflector antenna 220 may be configured such that it holds its spherical shape to within less than or equal to 1/16 of the wavelength of interest. Additionally, the dielectric support curtain(s) 246 may support/locate the feed system 260, which is pulled out of the balloon reflector canister 282 along with the balloon reflector antenna 220.

Figure 4:
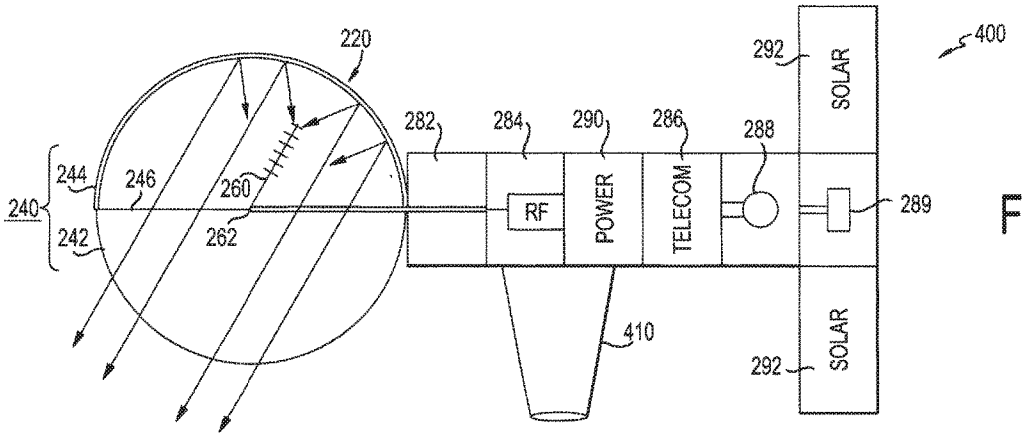
FIG. 4 is a diagram illustrating the balloon reflector antenna of FIG. 2 in conjunction with a satellite imaging system according to an exemplary embodiment of the present invention

FIG. 4 is a diagram illustrating the balloon reflector antenna 220 in conjunction with a satellite imaging system 410 according to an exemplary embodiment of the present invention. As shown in FIG. 4, the satellite 400 may include a balloon reflector antenna 220 and a conventional satellite imaging system 410. The satellite imaging system 410 captures images (e.g., images of the ground), which are output to the balloon reflector antenna 220 (e.g., via the RF module 284). Because the balloon reflector antenna 220 provides data rates of up to 50 Mbps (or more depending on transmitter power and reflector size), the satellite 400 is able to transmit satellite imagery captured by the satellite imaging system in its native resolution in real time.

Figure 5:
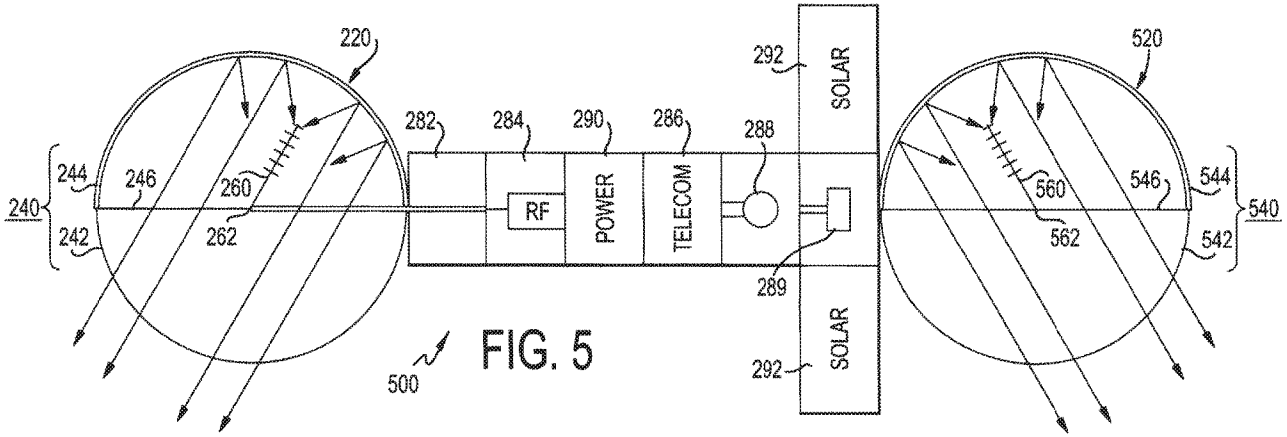
FIG. 5 is a diagram illustrating a satellite including the balloon reflector antenna of FIG. 2 and a second balloon reflector antenna according to exemplary embodiments of the present invention.

FIG. 5 is a diagram illustrating a satellite 500 including a first balloon reflector antenna 220 and a second balloon reflector antenna 520 according to exemplary embodiments of the present invention. Similar to the first balloon reflector antenna 220, the second balloon reflector antenna 520 includes a spherical balloon 540 with a transparent surface 542 and a reflective surface 544 and a feed system 560. The feed system 560 may include a motorized mount 562. The balloon 540 may include one or more dielectric support curtains 546.

In one embodiment, the second balloon reflector antenna 520 receives a signal (e.g., from a first point on the ground) and the first balloon reflector antenna 220 retransmits that signal (e.g., to a second point on the ground) to provide point-to-point communication. The satellite 500 may shift the signal from an uplink frequency to downlink frequency. Additionally or alternatively, the satellite 500 may use onboard processing to demodulate, decode, re-encode and modulate the signal. In a second embodiment, the second balloon reflector antenna 520 captures images via synthetic aperture radar (SAR) and the first balloon reflector antenna 220 transmits those images (e.g., to the ground).

The foregoing description and drawings should be considered as illustrative only of the principles of the inventive concept. Exemplary embodiments may be realized in a variety of sizes and are not intended to be limited by the preferred embodiments described above. Numerous applications of exemplary embodiments will readily occur to those skilled in the art. Therefore, it is not desired to limit the inventive concept to the specific examples disclosed or the exact construction and operation shown and described. Rather, all suitable modifications and equivalents may be resorted to, falling within the scope of this application.

What is claimed is:

1. A balloon reflector antenna, comprising:

a spherical balloon with a first hemisphere comprising a transparent surface that is transparent to electromagnetic waves and a second hemisphere, opposite the first hemisphere, comprising a reflective surface having a line of focus; and a feed system extending along one or more radial lines from a center of the spherical balloon that receives electromagnetic waves reflected off the reflective surface along the line of focus, wherein the balloon reflector antenna is configured such that the spherical balloon and the feed system are stowable in a canister during launch of a satellite.

2. The balloon reflector antenna of claim 1, wherein the feed system emits electromagnetic waves along the line of focus that are reflected off the reflective surface.

3. The balloon reflector antenna of claim 2, wherein the electromagnetic waves emitted by the feed system and reflected off the reflective surface pass through the transparent surface.

4. The balloon reflector antenna of claim 1, wherein the electromagnetic waves received by the feed system pass through the transparent surface before being reflected off the reflective surface.

5. The balloon reflector antenna of claim 1, wherein the transparent surface has an absorption rate of less than 1 percent at a wavelength of interest.

6. The balloon reflector antenna of claim 1, wherein the transparent surface is a flexible polymer.

7. The balloon reflector antenna of claim 1, wherein the transparent surface is approximately 0.5 mil thick.

8. The balloon reflector antenna of claim 1, wherein the reflective surface is formed by applying a metallic coating to the material that forms the transparent surface.

9. The balloon reflector antenna of claim 8, wherein the metallic coating is approximately 0.5 microns thick.

10. The balloon reflector antenna of claim 1, wherein the feed system is configured to pivot from the center of the spherical balloon to extend along any axis of the spherical balloon.

11. The balloon reflector antenna of claim 1, wherein the balloon reflector antenna is configured to transmit images captured by a satellite imaging system.

12. The balloon reflector antenna of claim 1, wherein the balloon reflector antenna is configured to transmit images captured by a second balloon reflector antenna via synthetic aperture radar.

13. The balloon reflector antenna of claim 1, wherein the balloon reflector antenna is configured to retransmit a signal received by a second balloon reflector antenna.

14. The balloon reflector antenna of claim 1, further comprising:

at least one dielectric support curtain along a diameter of the spherical balloon.

15. The balloon reflector antenna of claim 1, wherein the canister is one or more CubeSat units.

16. The balloon reflector antenna of claim 1, wherein the balloon reflector antenna is configured such that the spherical balloon is inflatable.

17. The balloon reflector antenna of claim 16, wherein the balloon reflector antenna is configured such that the feed system is pulled out of the canister when the spherical balloon is inflating or inflated.

18. A method of making a balloon reflector antenna, the method comprising:

providing a spherical balloon with a first hemisphere comprising a transparent surface that is transparent to electromagnetic waves and a second hemisphere, opposite the first hemisphere, comprising a reflective surface having a line of focus;

providing a feed system extending along one or more radial lines from the center of the balloon that receives electromagnetic waves reflected off the reflective surface along the line of focus;

stowing the spherical balloon, in an uninflated state, in a canister;

stowing the feed system in the canister;

launching a satellite that includes the canister into space;

inflating the spherical balloon while the satellite is in orbit, and pulling the feed system, while the satellite is in orbit, out of the canister into the inflating or inflated spherical balloon.

19. The method of claim 18, wherein the feed system emits electromagnetic waves along the line of focus that are reflected off the reflective surface.

20. The method of claim 18, wherein the canister is one or more CubeSat units.

21. The balloon reflector antenna of claim 1, wherein:

the transparent surface of the first hemisphere is continuous throughout the first hemisphere; and the reflective surface of the second hemisphere is continuous throughout the second hemisphere.

22. The method of claim 18, wherein the electromagnetic waves received by the feed system pass through the transparent surface before being reflected off the reflective surface.

23. The method of claim 19, wherein the spherical balloon is configured such that the electromagnetic waves that are reflected off the reflective surface pass through the transparent surface.

* * * * *